US005968590A

United States Patent [19]

Ahonen et al.

[11] Patent Number: 5,968,590

[45] Date of Patent: Oct. 19, 1999

[54] METHOD FOR DRYING A SURFACE-TREATED PAPER WEB IN AN AFTER-DRYER OF A PAPER MACHINE AND AFTER-DRYER OF A PAPER MACHINE

[75] Inventors: Pasi Ahonen; Juha Kaihovirta, both of Jyväskylä, Finland

[73] Assignee: Valmet Corporation, Helsinki, Finland

[21] Appl. No.: 08/932,889

[22] Filed: Sep. 17, 1997

Related U.S. Application Data

[60] Provisional application No. 60/030,692, Nov. 13, 1996.

[30] Foreign Application Priority Data

Sep. 20, 1996 [FI] Finland ..... 963735

[51] Int. Cl.[6] ..... D21F 5/00

[52] U.S. Cl. ..... 427/209; 34/455; 34/117

[58] Field of Search ..... 34/443, 444, 445, 34/452, 453, 454, 455, 463, 465, 114, 117, 119, 122; 162/135, 136; 427/209, 210

[56] References Cited

U.S. PATENT DOCUMENTS 5,022,163 6/1991 Ilvespaa et al. ..... 34/23
5,172,491 12/1992 Ilvespaa et al. ..... 34/115
5,495,678 3/1996 Ilmarinen et al. ..... 34/117
5,586,397 12/1996 Kerttula et al. ..... 34/114 X
5,756,156 5/1998 Elijoki et al. ..... 34/444 X

FOREIGN PATENT DOCUMENTS 80104 6/1989 Finland .
931263 9/1994 Finland .
98387 8/1996 Finland .

*Primary Examiner*—Henry Bennett
*Assistant Examiner*—Steve Gravini
*Attorney, Agent, or Firm*—Steinberg & Raskin, P.C.

[57] ABSTRACT

An after-dryer and method for drying a surface-treated paper web in an after-dryer of a paper machine in which the web is first finished in a finishing section, i.e., surface-sized or coated, by a finishing device and then dried. In the after-dryer, the paper web is dried in at least one dryer group that makes use of single-wire draw and at the same time, the paper web is dried by an impingement-drying equipment arranged in connection with at least one cylinder or roll in the single-wire dryer group.

26 Claims, 13 Drawing Sheets

FIG. 13
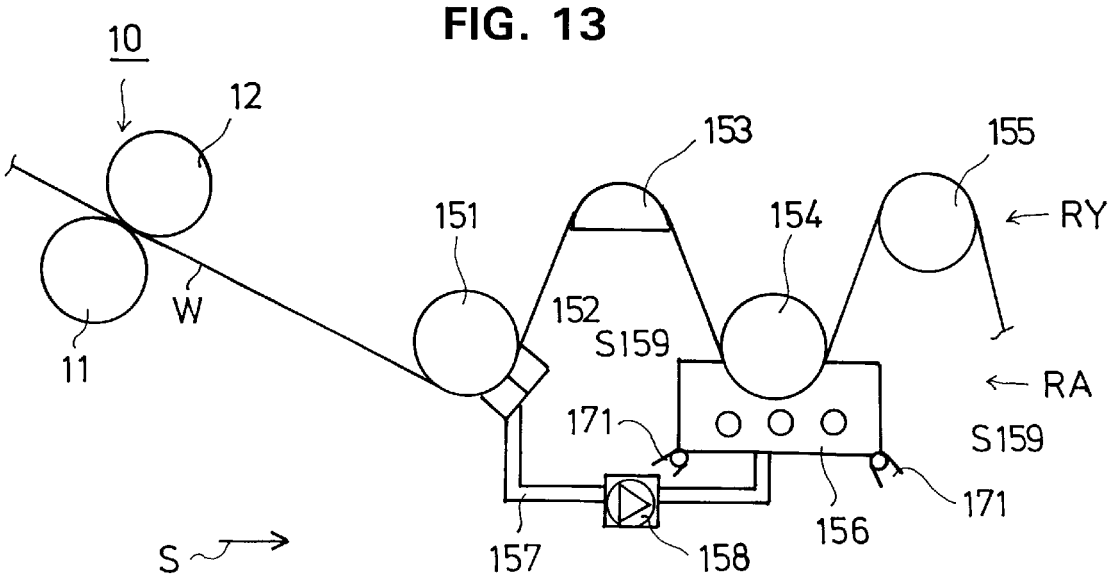
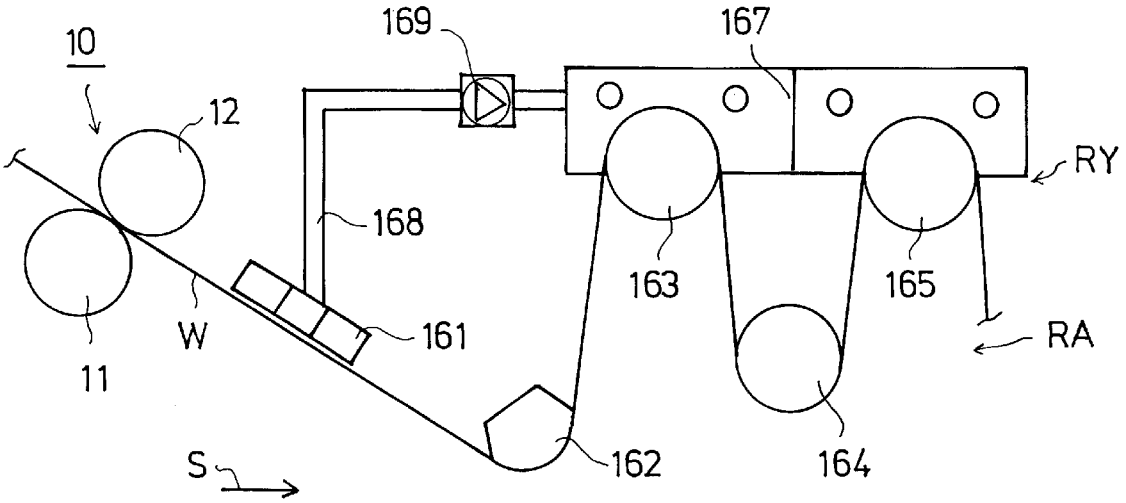
FIG. 14

METHOD FOR DRYING A SURFACE-TREATED PAPER WEB IN AN AFTER-DRYER OF A PAPER MACHINE AND AFTER-DRYER OF A PAPER MACHINE

This application claims benefit of Provisional Appln. 60/030,692, filed Nov. 13, 1996.

FIELD OF THE INVENTION

The present invention relates to a method for drying a surface-treated paper web or equivalent fibrous material in an after-dryer of a paper machine, in which the paper web is first finished in a finishing section, i.e., surface-sized or coated, by means of a finishing device, and then dried.

The invention also relates to an after-dryer for a paper machine for drying a surface-treated paper web or equivalent which is arranged after a finishing device in which the paper web is, e.g., surface-sized or coated.

As known in the prior art, in multi-cylinder dryers of paper machines, twin-wire draw and/or single-wire draw is/are employed. In groups of drying cylinders employing twin-wire draw, the groups of drying cylinders comprise two wires which press the web, one of which presses the web from above and the other of which presses the web from below, against heated cylinder faces of the drying cylinders. Between the rows of drying cylinders, which are usually horizontal rows, the web has free and unsupported draws, which are susceptible to fluttering, which may cause web breaks in particular when the web is still relatively moist and therefore has a low strength. For this reason, in recent years, ever increasing use has been made of drying cylinder groups employing single-wire draw wherein each group of drying cylinders includes only one drying wire on whose support the web runs through the entire group so that the drying wire presses the web on the drying cylinders against the heated cylinder faces, whereas the web remains at the side of the outside curve on the reversing cylinders or rolls arranged between the drying cylinders. Thus, in single-wire draw, the drying cylinders are arranged outside the wire loop, and the reversing cylinders or rolls are arranged inside the wire loop.

In so-called normal groups with single-wire draw, known in the prior art, the heated drying cylinders are placed in an upper row and the reversing cylinders are placed in a lower row below the upper row, which rows are generally horizontal and parallel to one another. On the other hand, in inverted groups with single-wire draw, the reversing cylinders are placed in the upper row and the drying cylinders in the lower row. In the following, when the terms "normal (dryer) group" and "inverted (dryer) group" are used, what is meant is expressly groups with single-wire draw in multi-cylinder dryers, of the type mentioned above.

When a paper web is dried by means of normal groups with single-wire draw from the side of only its bottom face, it is dried asymmetrically and if such asymmetric drying is extended over the entire length of the forward dryer section, the drying takes place so that first the bottom-face side of the paper web is dried and, when the drying makes progress, the drying effect is also extended to the side of the top face of the paper web. Under these circumstances, the dried paper is usually curled and becomes concave, seen from above.

As known in the prior art, the tendency of curling of paper is already affected in connection with the web formation, in particular at the sheet formation stage by means of the selection of the difference in speed between the slice jet and the wire, and by means of other running parameters during production of the paper web. As known from the prior art, for example, in the case of copying paper, by means of unequalsidedness of drying in the after-dryer, a suitable initial curl form is regulated for the sheet in order that the curling of the paper after one-sided or double-sided copying may be optimized. In the case of copying paper, the reactivity of curling, i.e., the extent to which curling occurs per unit of change in moisture content, is affected to a greater extent by means of a multi-layer structure of the paper web, which is produced in connection with the web formation in the wet end of the paper machine.

The most recent technology related to the present invention in high-speed paper machines, in particular in fine-paper machines, has been based on dryer sections in which there is single-wire draw over the major part of the length of the machine and, in view of controlling the tendency of curling of paper, in practice, an inverted group has also been used in order that the drying can be made sufficiently symmetric in the z-direction (the direction of thickness of the web).

From the prior art, constructions are known for an after-dryer for paper to be coated, in particular for fine paper or equivalent, in which dryer there is first an upper cylinder and a lower cylinder and after this, one group that employs normal single-wire draw, and after the single normal-wire draw group, one or more dryer groups that make use of twin-wire draw. In these applications, it is a problem that, in view of the tendency of curling of paper, the ratio of the upper and lower cylinders is incorrect if the curling is supposed to be regulated efficiently. Further, in conventional after-dryers, it has been necessary to keep the temperature of the first cylinders low because of adhering of the web and the size/paste to the cylinder. For this reason, the heating of the web on the cylinders either in single-wire draw or in twin-wire draw has taken an unduly high proportion of the length of the machine in relation to the capacity that is provided.

Groups of the type mentioned above for finishing paper to be coated, in particular fine paper, have been described, among other things, in the current assignee's Finnish Patent Application No. 950434 corresponding to the current assignee's U.S. patent application Ser. Nos. 08/467,780 (now abandoned) and 08/705,059 incorporated by reference herein.

With respect to the prior art, reference can also be made to the current assignee's Finnish Patent Application No. 931263 (corresponding to European Patent Application No. 0 620 313 and U.S. Pat. No. 5,495,678, incorporated by reference herein), in which a favorable arrangement is described for combining impingement drying with a prior art cylinder dryer group that applies single-wire draw.

Furthermore, in the prior art, it is known to use an electric or gas infra-red (infra) heater after a coating station or surface-sizing unit. Also, it is known to use a so-called combination dryer, in which the hot air of an infra heater is passed into a so-called airborne web dryer.

OBJECTS AND SUMMARY OF THE INVENTION

It is an object of the present invention to further develop the paper machine constructions suggested in the above-mentioned Finnish patent applications so that the tendency of curling of paper can be controlled more efficiently in the after-dryer of the paper machine.

It is another object of the present invention to provide a solution in which the curling of paper is controlled so that the after-dryer does, however, not become substantially longer in comparison with existing after-dryers.

It is a further object of the invention to provide a construction for an after-dryer which is suitable for use in particular in dryer sections in which it has not been possible or desirable to control the curling of the paper web in the forward dryer section thereof.

It is a further object of the present invention to provide an after-dryer for a paper machine in which the runnability of the web can be brought to a particularly high level.

It is yet another object of the invention to provide an after-dryer of a paper machine which has an efficient drying capacity.

It is a further object of the invention to provide an after-dryer for a paper machine which is advantageous in view of the consumption of energy.

A specific object of the invention is to create novel constructions for an after-dryer of a paper machine in which the runnability of the web, efficiency and control of curling of the web are optimized.

In view of achieving the objects stated above and others, in the method in accordance with the invention, in the after-dryer the paper web is dried in at least one dryer group that makes use of single-wire draw, and at the same time, the paper web is dried by means of an impingement-drying equipment arranged in connection with at least one cylinder or roll in that dryer group(s).

Further, the after-dryer in accordance with the invention comprises at least one dryer group that applies single-wire draw, and an impingement-drying equipment arranged in connection with at least one cylinder or roll in that dryer group(s).

In accordance with one exemplifying embodiment of the invention, an inverted group with single-wire draw is arranged in the beginning of the after-dryer and includes suction rolls or cylinders, above at least one of which suction cylinders or equivalent reversing rolls/cylinders, one or more impingement blowing hoods are placed. This construction is advantageous because single-wire draw has a good runnability and does not require threading by means of a rope and, moreover, impingement drying dries the coated side of the paper web efficiently. By means of this construction, among other things, an advantage is obtained that the web is heated quickly whereby efficient evaporation of the water present in the web surface is achieved. The impingement blowing does not affect the curling, and the curling may be regulated in a group with twin-wire draw arranged after the inverted group with single-wire draw in the running direction of the web by adjusting the steam pressures in the rows of upper and lower cylinders in the twin-wire draw group to suitable levels. The arrangement in accordance with the invention permits the construction of a shorter after-dryer and has a better energy economy than infrared dryers etc., devices based on electric energy, because in impingement drying, it is possible to use, for example, combustion gases from liquefied petroleum gas which are more advantageous than electricity. In comparison to an airborne web dryer, an important advantage of the system in accordance with the present invention is good runnability. Moreover, in the arrangement in accordance with the invention, the efficiency can be regulated readily and also, the impingement drying provides a possibility for profiling.

In an arrangement in accordance with a preferred embodiment of the present invention, impingement drying is applied to the drying of a coating and, in the same way as in a combined infrared/airborne-web dryer, the air heated by the infrared dryer is utilized in the impingement drying unit. Warm air can be used as replacement air for the impingement drying unit, and also directly as impingement blow air, to replace air that has to be heated otherwise, or it can also be used as preheated air for a burner by whose means the blow air is heated. In view of increasing the efficiency of the after-dryer, a construction which is particularly favorable is one in which gas infrared dryers are available and utilized. In such an arrangement, in connection with the after-dryer, there is a gas dryer or gas infra dryer in pre-drying after the coating or surface-sizing device and before cylinder drying and/or impingement drying units. Advantages that are obtained by means of this equipment include economies of energy and good draw of the web.

A basic embodiment of the method for drying a paper web in accordance with the invention comprises the steps of passing the web through at least one single-wire draw dryer group, each including first and second rows of web-supporting members, e.g., drying cylinders, reversing cylinders, reversing blow devices, large-diameter drying cylinders, etc., and a single drying wire for carrying the web alternatingly between one of the web-supporting members in the first row and one of the web-supporting members in the second row, arranging an impingement-drying device in opposed relationship to at least one of the web-supporting members in one or more of the single-wire draw dryer groups, and directing a drying medium from the impingement-drying device toward the web as the web runs over the web-supporting member(s). At times, the web-supporting members in the first row in a first one of the single-wire draw dryer groups in a running direction of the web constitute reversing cylinders and the web-supporting members in the second row constitute drying cylinders. In this case, the second row of drying cylinders may be arranged below the first row of reversing cylinders such that the first single-wire draw dryer group constitutes an inverted single-wire draw dryer group whereby the impingement-drying device is arranged in opposed relationship to at least one of the reversing cylinders.

In some embodiments, the web may be dried between the finishing device and the single-wire draw dryer group(s) by means of an airborne web dryer and possibly passed over a reversing blow device after the finishing device and before the airborne web dryer to change the running direction of the web. The web may be pre-dried after the finishing device and before the single-wire draw dryer group(s) by means of an infra dryer which generates exhaust air, and the exhaust air is directed from the infra dryer to the impingement-drying device.

In the following, the invention will be described in more detail with reference to the figures in the accompanying drawings. However, the invention is not strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which:

FIG. 13 is a schematic illustration of an exemplifying embodiment of the invention in which an infra dryer is arranged in the beginning of the after-dryer connected with the first cylinder and whose heat is used in connection with impingement drying, and a reversing blow device is arranged between the infra and the impingement dryer; and FIG. 14 is a schematic illustration of an exemplifying embodiment of the invention in which the web is dried by means of an infra dryer or a gas dryer after the coating whose heat is utilized in impingement drying, and in which a reversing blow box is arranged after the infra dryer which is followed by an impingement dryer group.

DETAILED DESCRIPTION OF THE PREFERRED EMBODIMENTS

Figure 1:
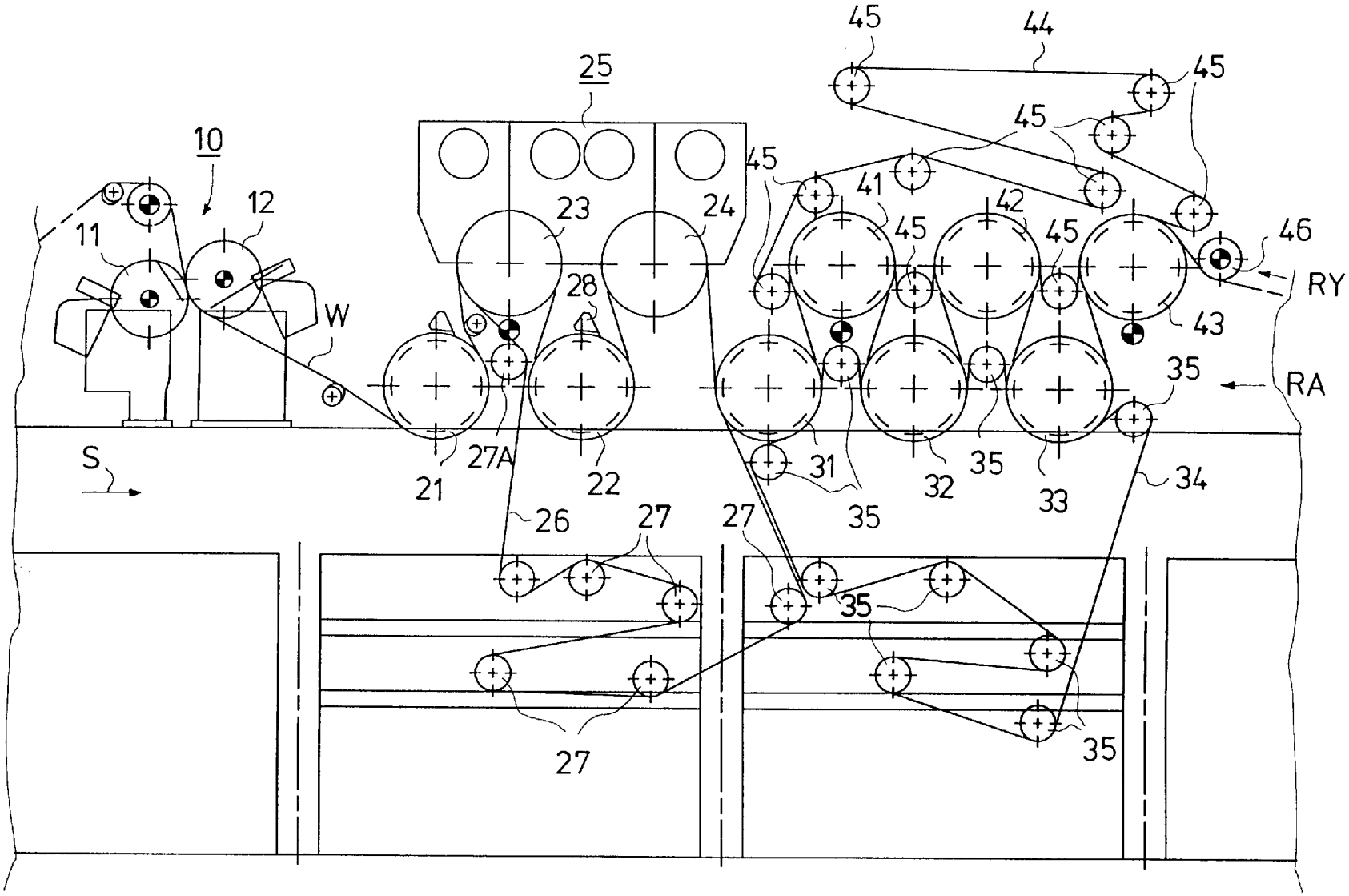
FIG. 1 is a schematic illustration of an exemplifying embodiment of the invention in which there is a dryer group that makes use of single-wire draw in the beginning of the after-dryer, in which reversing rolls/cylinders are provided with an impingement drying device, and a dryer group with twin-wire draw arranged after the group with single-wire draw.

Referring to the accompanying drawings wherein like reference numerals refer to the same or similar elements, in FIG. 1, a coating device is denoted by reference numeral 10 and is, for example, a coating device marketed by the current assignee under the tradename SYM-SIZER™, which device comprises two opposite coating rolls 11 and 12, in connection with each of which there is a size feed device so that a paper web W is coated from both sides as it passes through a coating nip defined by the rolls 11 and 12. After the coating nip, the web W is passed into an after-dryer onto its first drying cylinder 21 placed in a lower row RA, over which the web W is passed into an inverted dryer group with single-wire draw of the after-dryer, and more specifically onto its first reversing roll/cylinder 23 in an upper row RY. From the first reversing roll/cylinder 23, the web W is passed by means of a drying wire or an equivalent support fabric 26 onto a drying cylinder 22 in the lower row RA and further onto a reversing roll or cylinder 24 in the upper row RY. In connection with the reversing rolls or cylinders 23,24 in the upper row RY, an impingement blowing equipment 25 is arranged by whose means drying gas/air jets are blown toward the web W. The guide rolls of the drying wire 26 are denoted by reference numeral 27, and by means of a guide roll 27A, the run of the drying wire 26 is shifted so that it does not reach contact with the web W to be dried that runs over the drying cylinder 21.

From the reversing roll/cylinder 24, the web W is passed as a closed draw supported by the drying wire 26 into a dryer group with twin-wire draw onto a first drying cylinder 31 in its lower row RA of drying cylinders. In FIG. 1, the drying cylinders in the lower row RA are denoted by reference numerals 31,32 and 33, and the web W runs alternating and meandering over these drying cylinders 31,32,33 onto drying cylinders 41,42 and 43 in the upper row RY. A drying wire 34 of the lower-row RA cylinders 31,32,33 runs guided by guide rolls 35, and a drying wire 44 of the upper row RY runs guided by guide rolls 45. The web W is passed over a guide roll/alignment roll 46 to further processing. In connection with the drying cylinders, a doctor 28 can be provided.

As the reversing rolls/cylinders, particularly favorably are used the suction cylinders marketed by the current assignee under the trade mark "VAC-ROLL"™ and provided without an interior suction box, reference being made, with respect to the details of the constructions of such rolls, to the current assignee's Finnish Patent No. 83,680 (corresponding to U.S. Pat. Nos. 5,022,163 and 5,172,491 incorporated by reference herein). Instead of the Vac-Roll suction cylinders, it is also possible to use rolls marketed by the current assignee under the trade mark UNO or cold or hot cylinders in themselves known.

Figure 2:
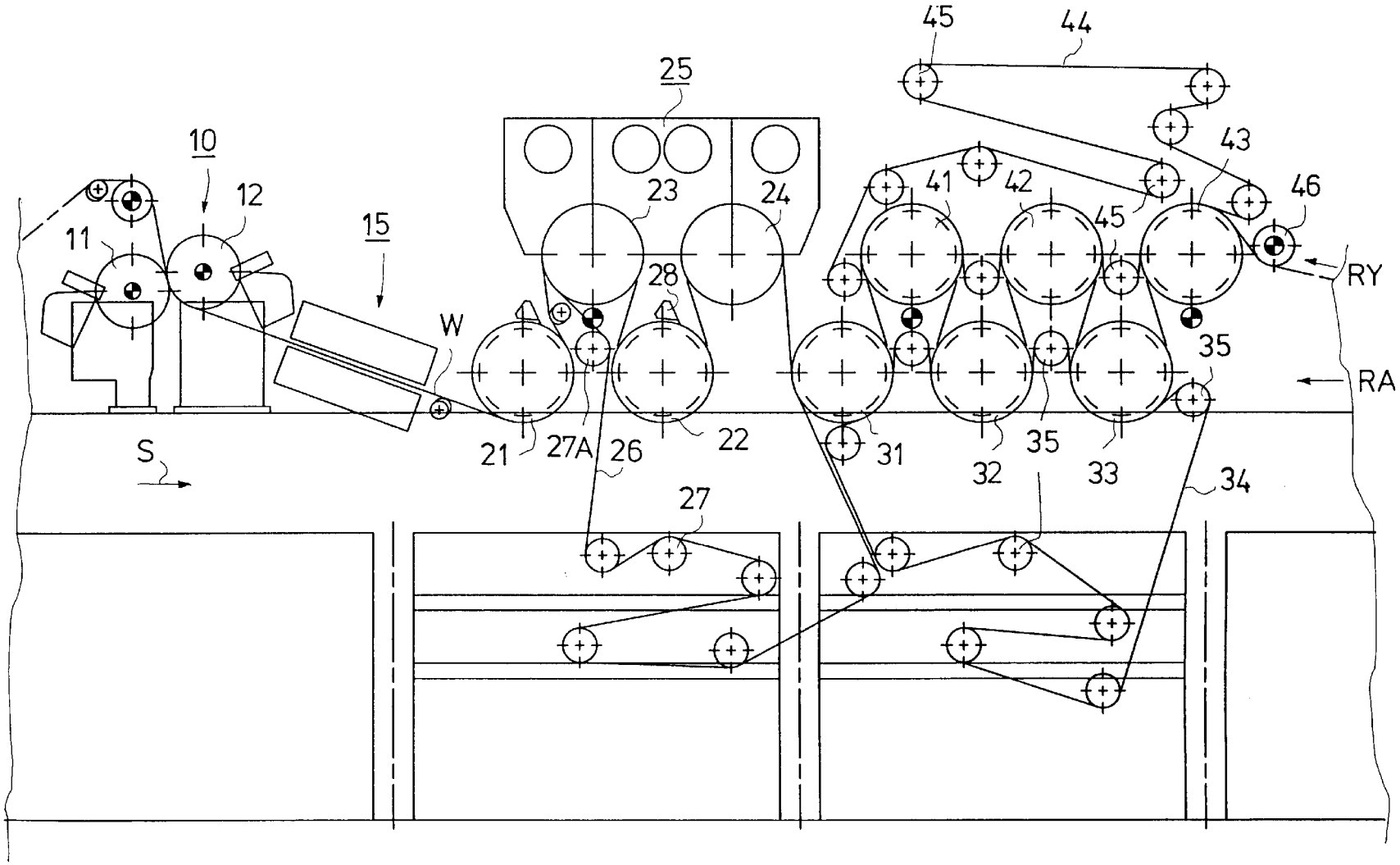
FIG. 2 is a schematic illustration of an after-dryer in accordance with the invention substantially similar to that shown in FIG. 1, in which the first drying equipment is an airborne web dryer.

The exemplifying embodiment shown in FIG. 2 is substantially similar to that shown in FIG. 1, and corresponding parts are denoted by the same reference numerals. However, unlike the exemplifying embodiment shown in FIG. 1, in FIG. 2 the web W coated by means of the coating device 10 is first passed through an airborne web dryer 15, which operates as a pre-dryer, before the first drying cylinder 21.

Figure 3:
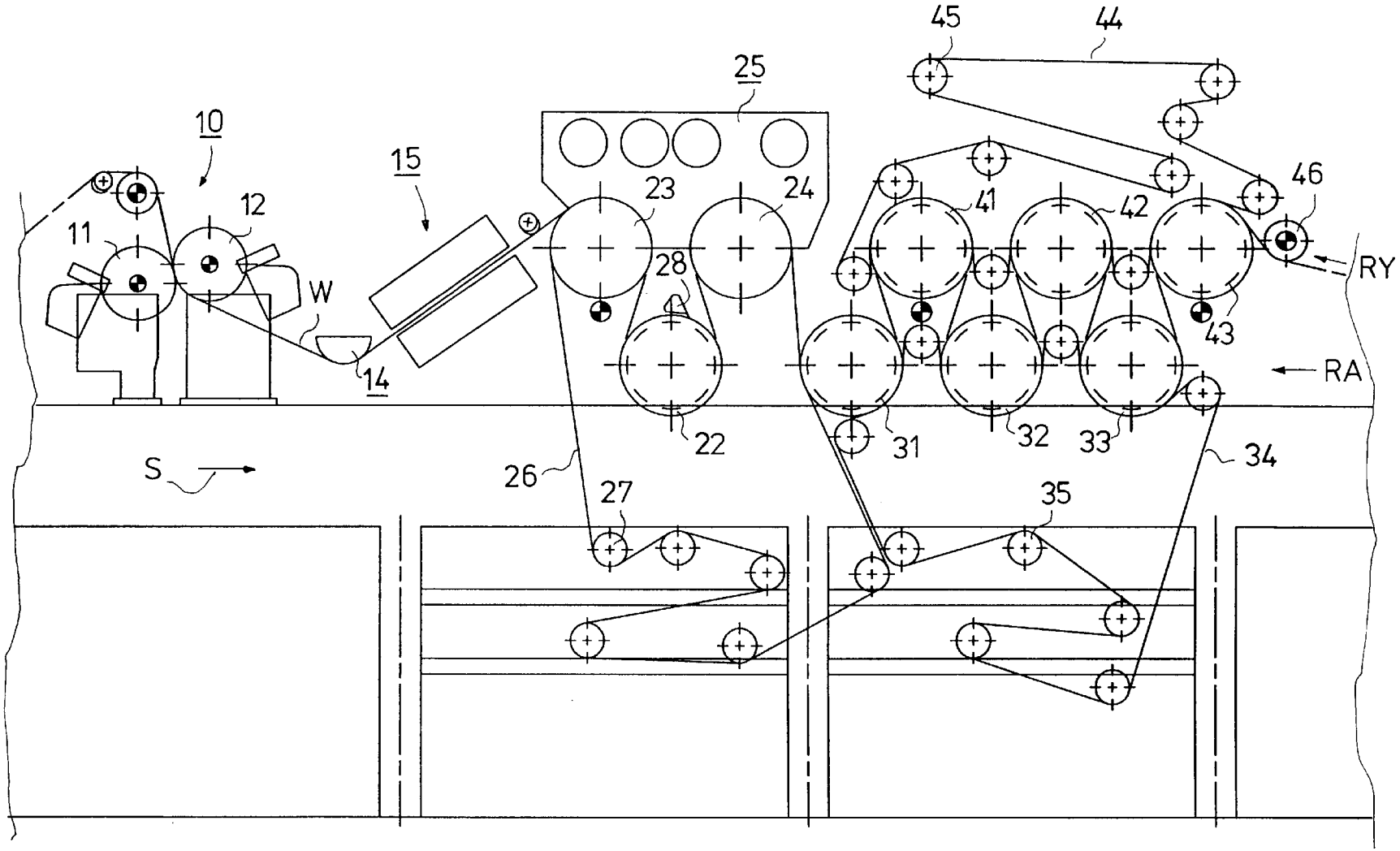
FIG. 3 shows an exemplifying embodiment of the invention substantially similar to those shown in FIGS. 1 and 2, but in this embodiment the web is turned by means of a reversing blow box after coating.

The exemplifying embodiment shown in FIG. 3 is substantially similar to those shown in FIGS. 1 and 2, and corresponding parts are denoted by the same reference numerals. It is a difference in this exemplifying embodiment that after the coating device 10, the paper web W is passed over a reversing blow device 14 into an airborne web dryer 15 operating as a pre-dryer, and from the airborne web dryer 15 directly onto the first reversing roll/cylinder 23 in the upper row RY in an inverted group with single-wire draw. The reversing blow device 14 changes the running direction of the web.

Figure 4:
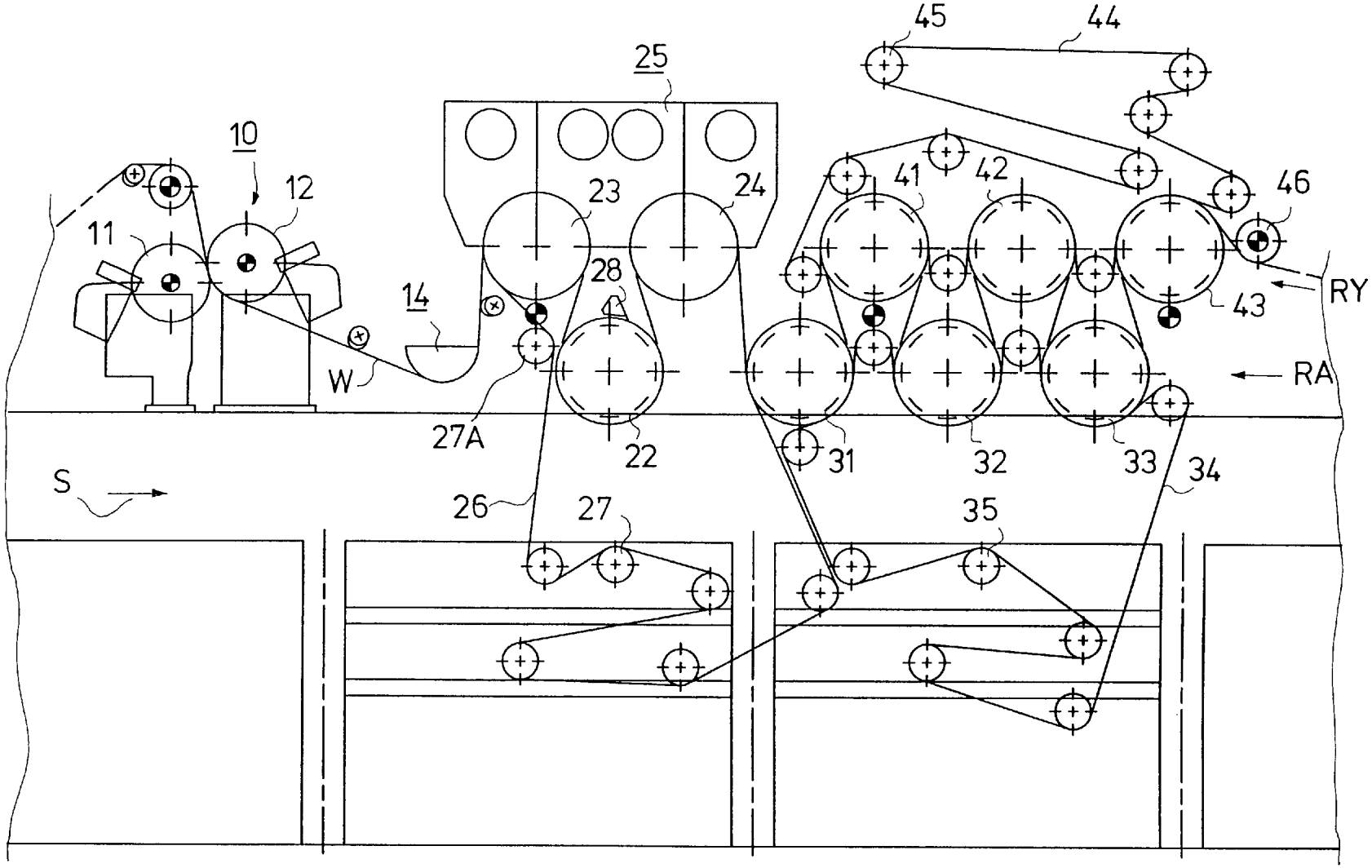
FIG. 4 is a schematic illustration of an exemplifying embodiment of the invention in which the web is turned by means of a reversing blow box after coating/surface-sizing and passed into an inverted dryer group that applies single-wire draw and in which impingement drying devices are arranged in connection with the reversing rolls/cylinders, after which there follows a dryer group that applies twin-wire draw.

The exemplifying embodiment shown in FIG. 4 is substantially similar to the exemplifying embodiments shown in FIGS. 1–3, but in this exemplifying embodiment, after the coating device 10, the web W is passed over a reversing blow device 14 directly onto the first reversing roll/cylinder 23 in the upper row RY in an inverted group with single-wire draw.

Figure 5:
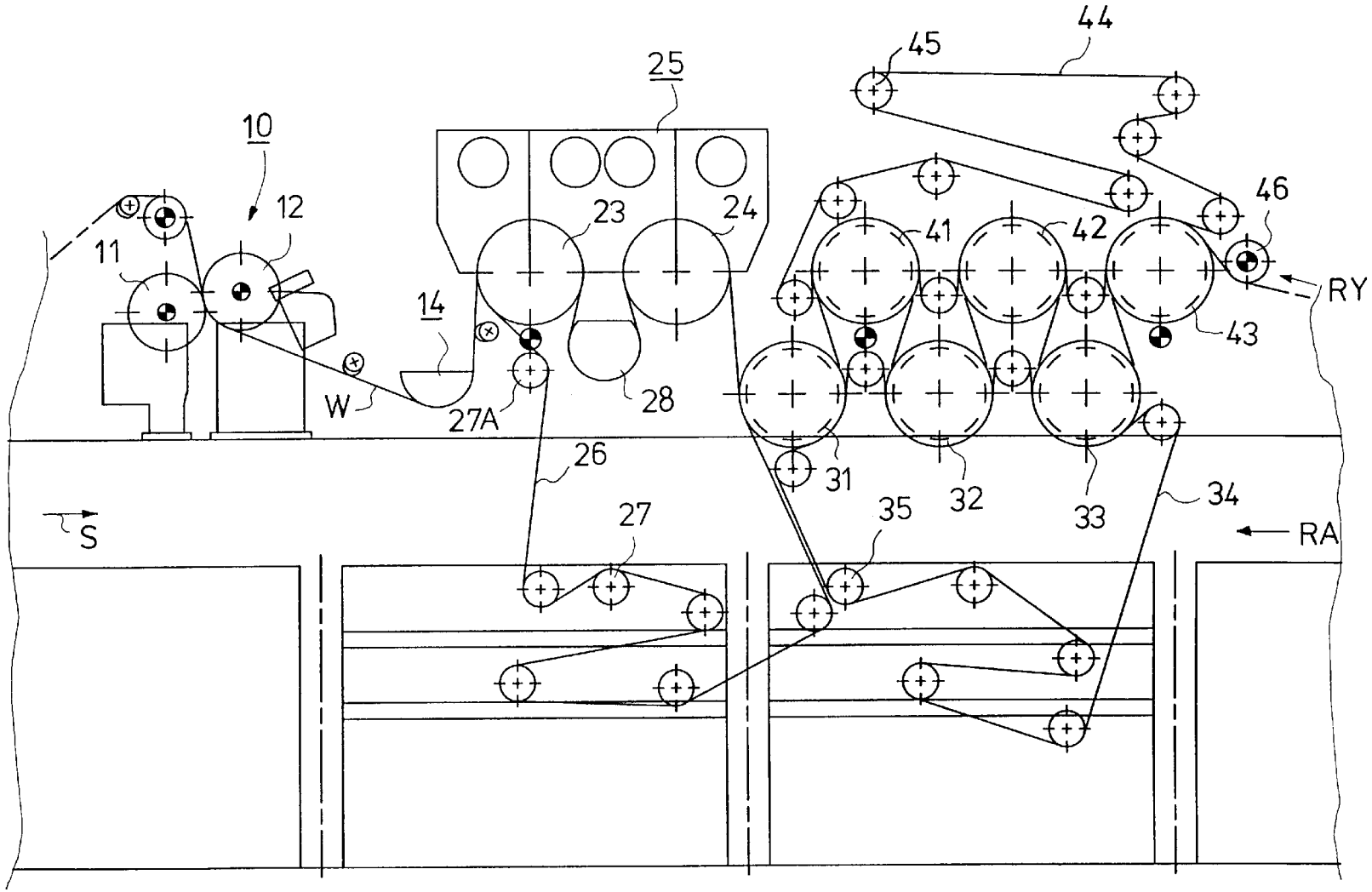
FIG. 5 is a schematic illustration of an exemplifying embodiment of the invention which is substantially similar to that shown in FIG. 4, but includes a reversing blow box instead of the drying cylinder in the inverted dryer group with single-wire draw.

The exemplifying embodiment shown in FIG. 5 is substantially similar to that shown in FIG. 4, except that the drying cylinder 22 in the lower row RA in the first inverted dryer group with single-wire draw has been substituted for by a reversing blow device 28. Thus, there are no reversing cylinders in the first single-wire draw group in this embodiment.

Figure 6:
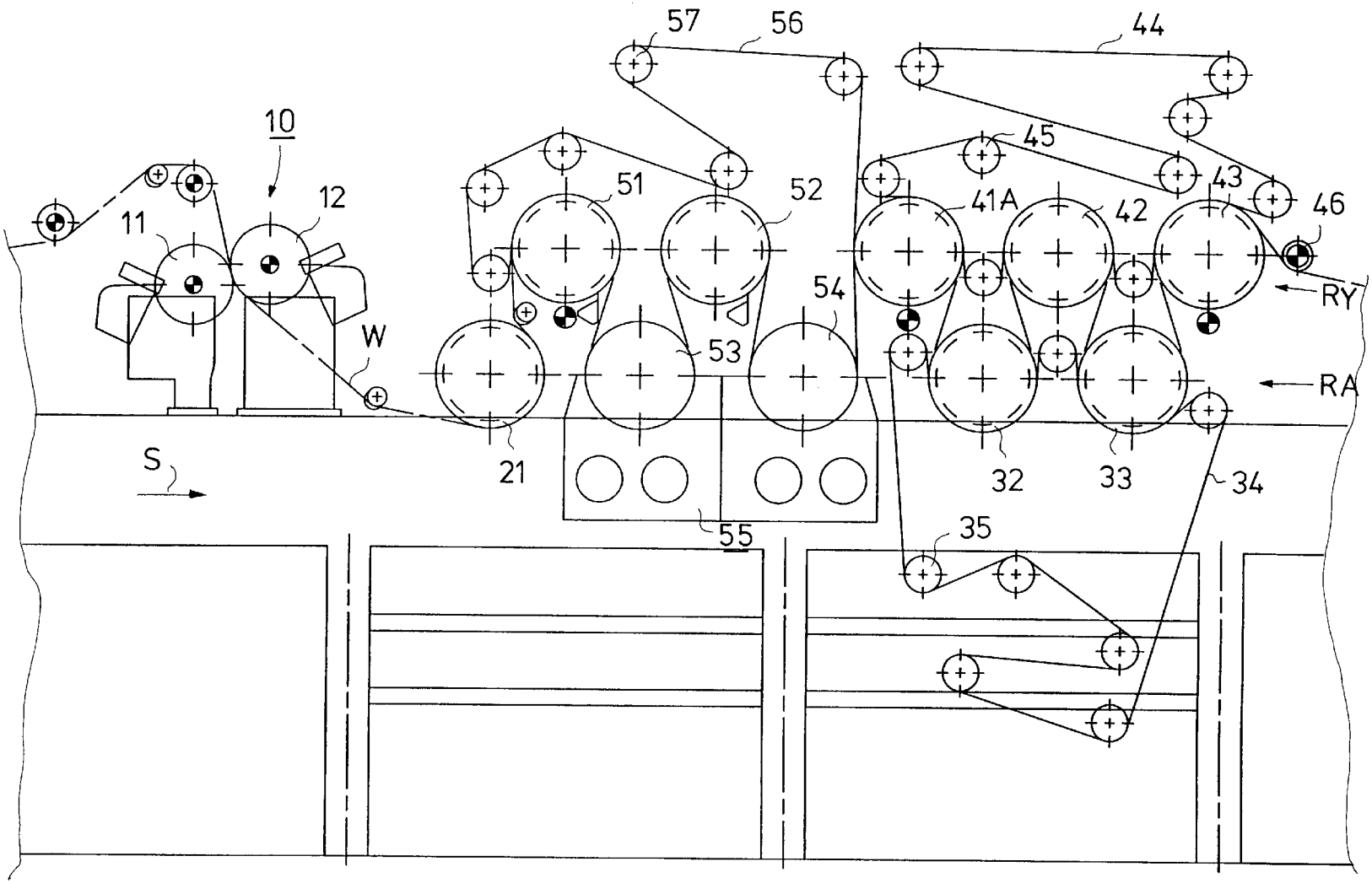
FIG. 6 is a schematic illustration of an exemplifying embodiment of the invention in which the first dryer group is a group with normal single-wire draw, in which group, in connection with the reversing rolls, impingement drying units are arranged, which are followed by a dryer group with twin-wire draw.

In the exemplifying embodiment shown in FIG. 6, the coated web W is passed from the coating device 10 over the drying cylinder 21 onto a first drying cylinder 51 in the upper row RY in a normal dryer group with single-wire draw. This dryer group comprises two drying cylinders 51 and 52 in the upper row RY and two reversing rolls or cylinders 53,54 in the lower row RA. In connection with the reversing rolls/cylinders, an impingement drying equipment 55 is arranged. The drying wire is denoted by reference numeral 56 and the guide rolls are denoted by reference numeral 57. After this dryer group, the web W is passed as a closed draw by means of a drying wire 56 onto a first drying cylinder 41A in the upper row RY in a dryer group with twin-wire draw. In the other respects, the dryer group with twin-wire draw is similar to the twin-wire draw illustrated in the preceding embodiments.

Figure 7:
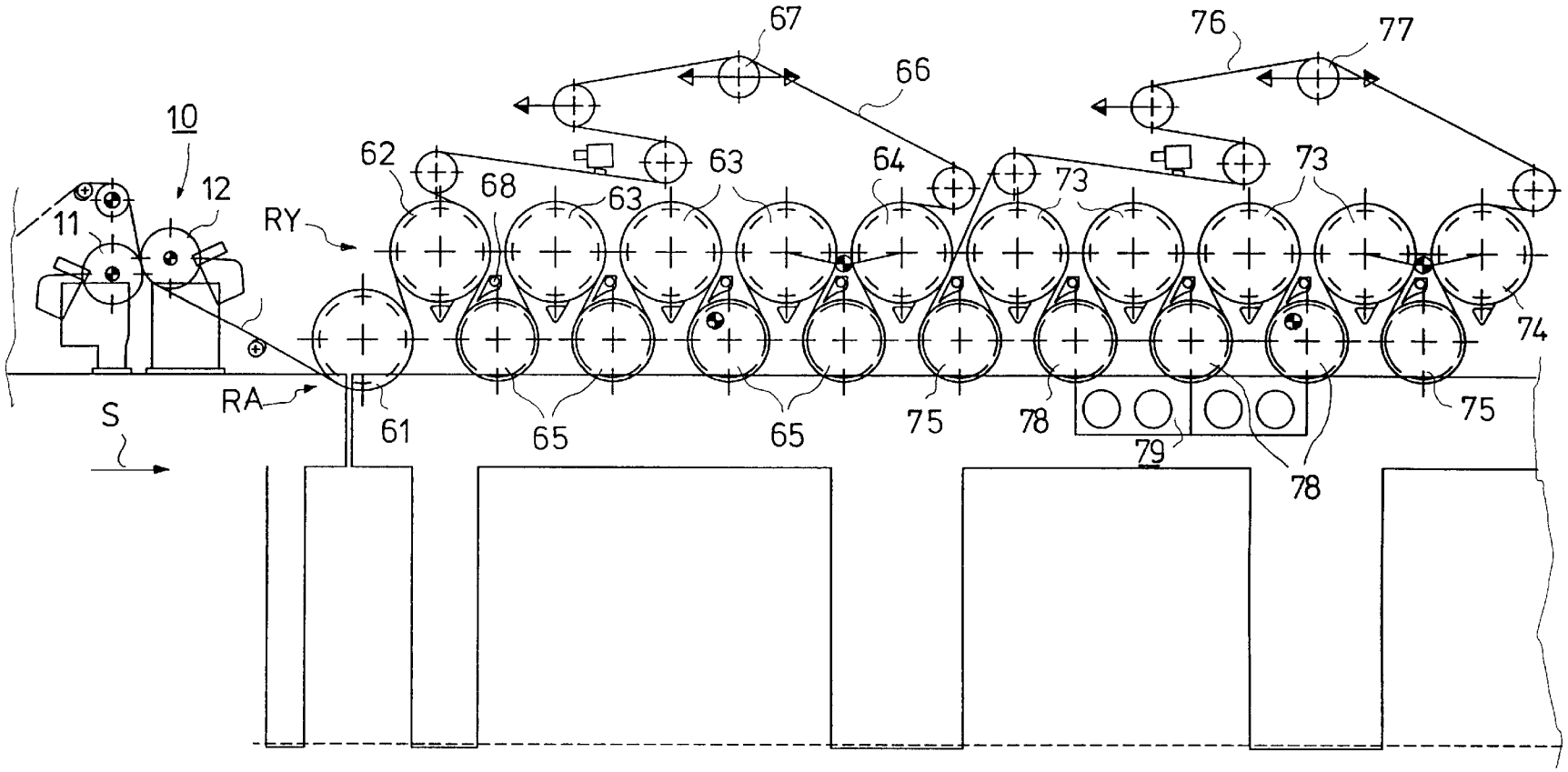
FIG. 7 is a schematic illustration of an exemplifying embodiment of the invention in which the first group in the after-dryer is a normal dryer group with single-wire draw, which group is followed by a second normal group with single-wire draw, in which group impingement drying devices are arranged in connection with some of the reversing rolls.

In the exemplifying embodiment shown in FIG. 7, the coating device 10 is followed by a dryer group with normal single-wire draw, into which the coated paper web W is passed over drying cylinders 61 and 62. Supported on the drying wire 66, the paper web W to be dried runs meandering over reversing rolls/cylinders 65 in the lower row RA and drying cylinders 63 in the upper row RY onto a drying cylinder 64, from which the web W is passed into the next dryer group with normal single-wire draw as a closed draw onto a drying wire 76 of this group. On support of drying wire 76, the paper web W runs meandering over reversing rolls/cylinders 75,78 in the lower row RA and drying cylinders 73 in the upper row. In connection with the middle reversing rolls/cylinders 78 in the lower row, impingement drying devices 79 are arranged for further drying of the web by means of drying blowings. The web W is passed over the drying cylinder 74 to further processing. In dryer groups with single-wire draw, blow boxes 68 or equivalent are used, for example devices 68 which are marketed by the current assignee under the trademark UNO-RUN-BLOW-BOX and which improve the runnability of the web. Of course, these devices can also be used in the exemplifying embodiments shown in the other illustrations.

Figure 8:
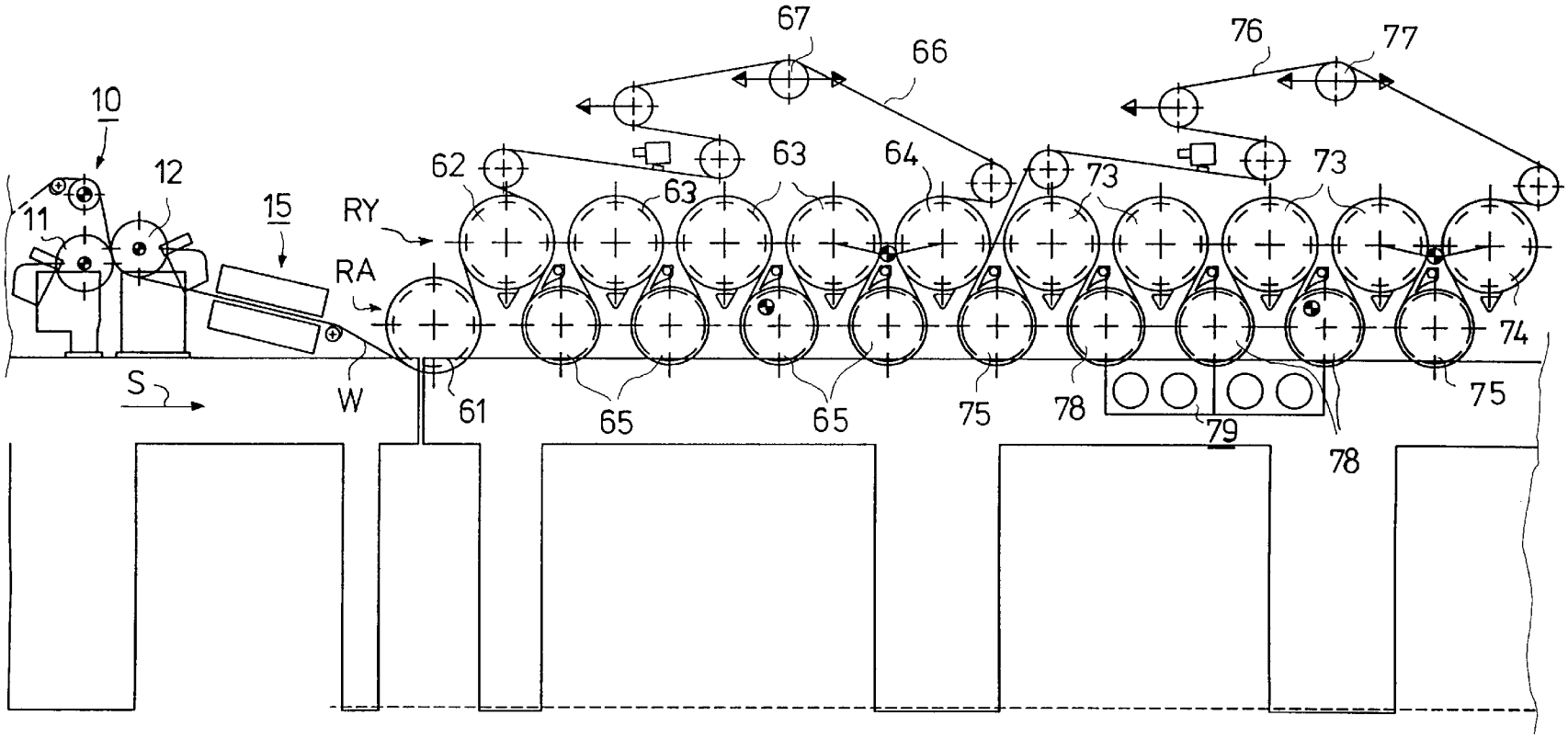
FIG. 8 is a schematic illustration of an exemplifying embodiment of the invention which is substantially similar to that shown in FIG. 7, but the first dryer device in the after-dryer, before the groups with single-wire draw, is an airborne web dryer.

The exemplifying embodiment shown in FIG. 8 is substantially similar to that shown in FIG. 7, except that in this embodiment the web W is passed from the coating device 10 through the airborne web dryer 15 operating as a pre-dryer over the drying cylinders 61,62 into dryer groups that apply a normal single-wire draw.

Figure 9:
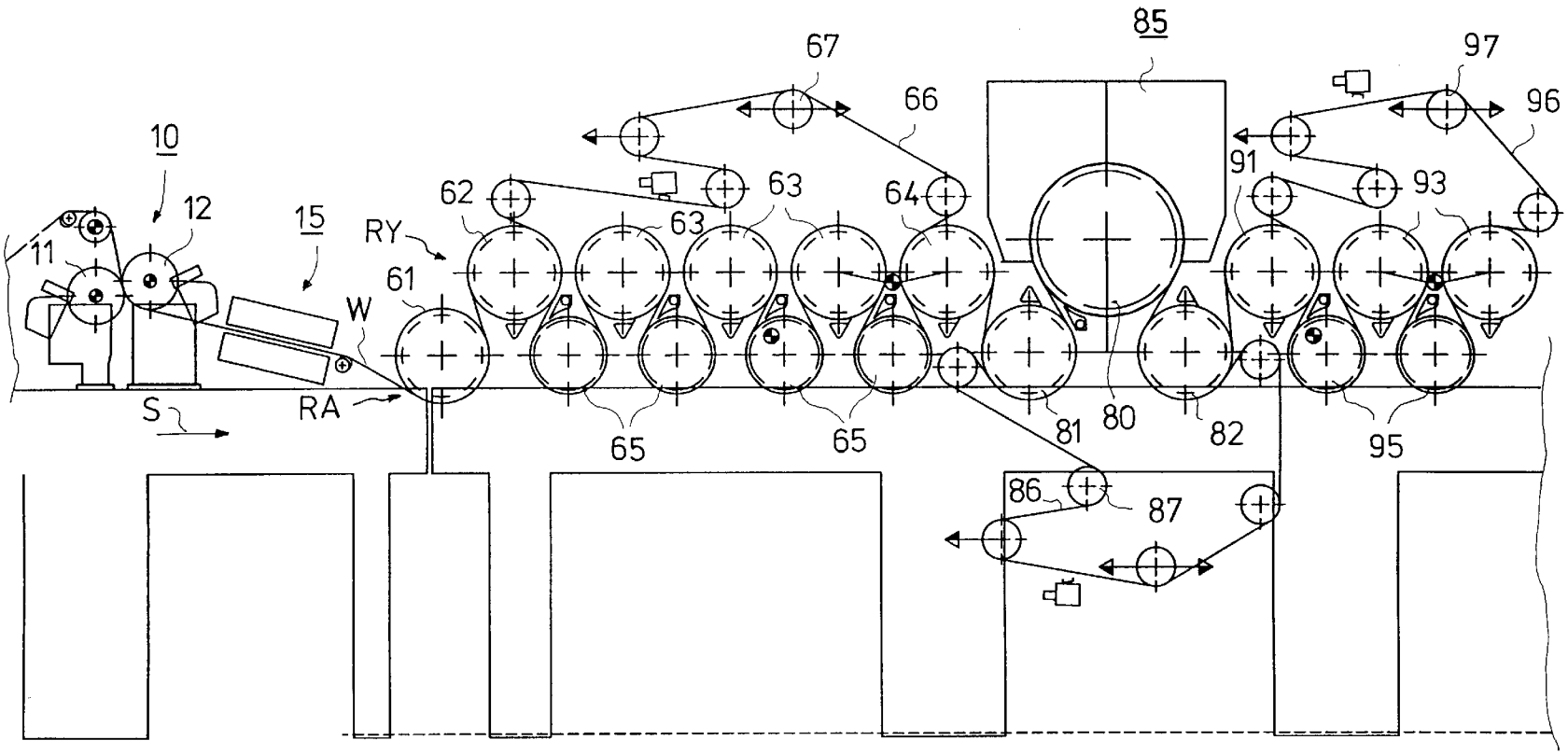
FIG. 9 is a schematic illustration of an exemplifying embodiment of the invention in which an airborne web dryer equipment is followed by a normal dryer group with single-wire draw, after which group a cylinder of very large diameter is placed, in connection with which cylinder impingement drying devices are arranged and which cylinder is followed by a normal dryer group that applies single-wire draw.

The exemplifying embodiment shown in FIG. 9 is substantially similar to that shown in FIG. 8, and in this embodiment, after the coating device 10, the coated paper web W is passed through the airborne web dryer 15 over the cylinders 61,62 into the first normal dryer group with single-wire draw. Thereafter, the web W is passed over a drying cylinder 81 around a large-diameter roll 80, in connection with which roll an impingement drying equipment 85 is provided. The diameter of the large-diameter roll is from about 20% to about 150%, preferably from about 25% to about 90%, larger than the diameter of the other, ordinary drying cylinders. After this, there follows the drying cylinder 82 in the lower row, from which the web W is passed over a drying cylinder 91 into a normal dryer group with single-wire draw, whose reversing rolls/cylinders are denoted by reference numeral 95 and drying cylinders are denoted by reference numeral 93. The drying wire is denoted by reference numeral 96, and its guide rolls are denoted by reference numeral 97.

Figure 10:
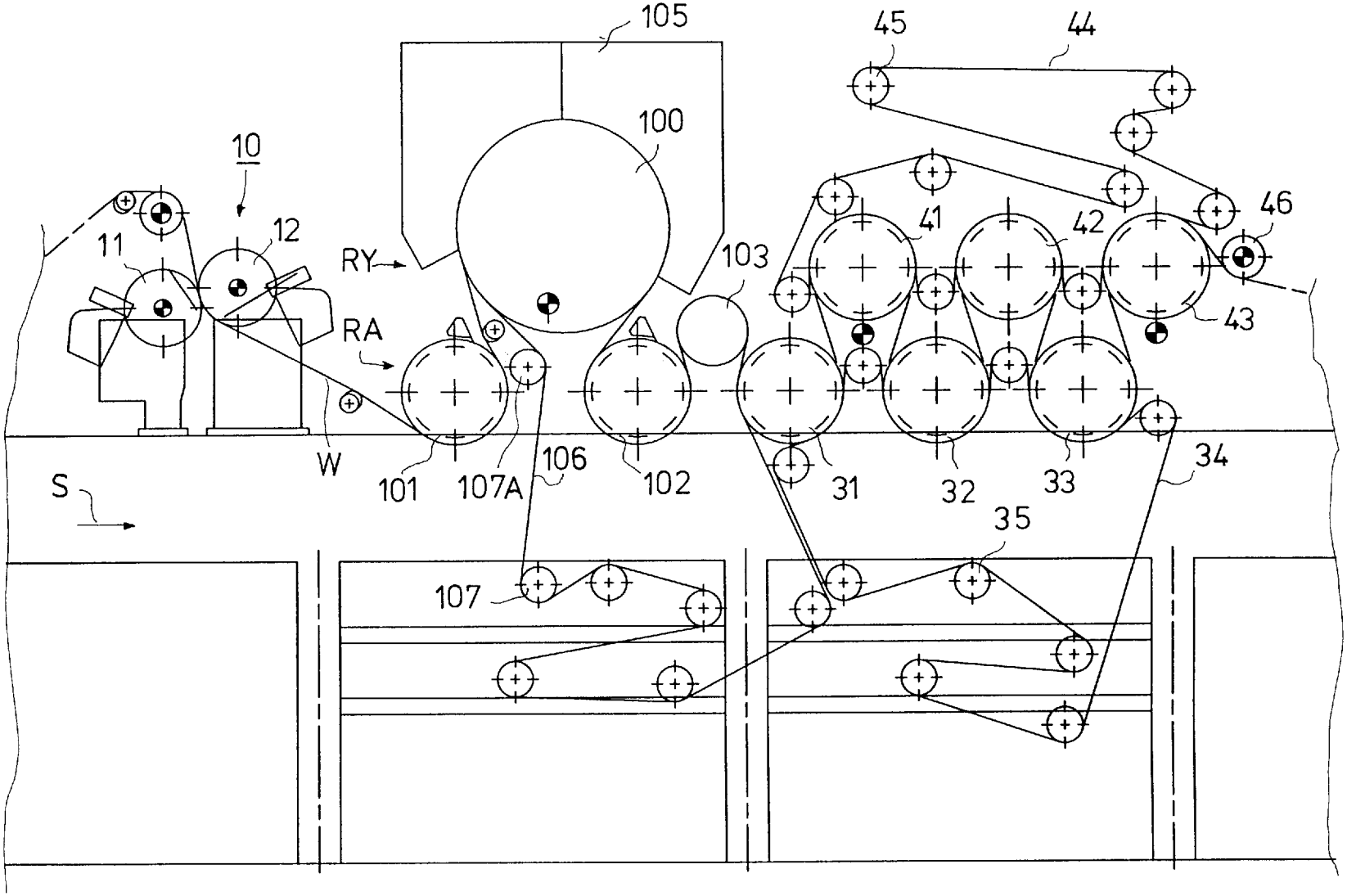
FIG. 10 is a schematic illustration of an exemplifying embodiment of the invention in which the first dryer group in the after-dryer is provided with a reversing cylinder/roll of large diameter, in connection with which impingement drying devices are arranged and which is followed by a dryer group that applies twin-wire draw.

In the exemplifying embodiment shown in FIG. 10, after the coating device 10, the paper web W is passed over a drying cylinder 101 onto a face of a large diameter roll 100, in whose connection an impingement drying equipment 105 is arranged. The large-diameter roll 100 is followed by a drying cylinder 102 and by a reversing roll/cylinder 103, after which the web W is passed into a dryer group with twin-wire draw, which is substantially similar to that described above, for example, in relation to FIG. 1. In connection with the large-diameter roll 100, a drying wire 106 of its own is provided, whose guide rolls are denoted by reference numeral 107. By means of the guide roll 107A, the run of the drying wire is shifted so that it does not reach contact with the paper web W to be dried which runs over the drying cylinder 101.

Figure 11:
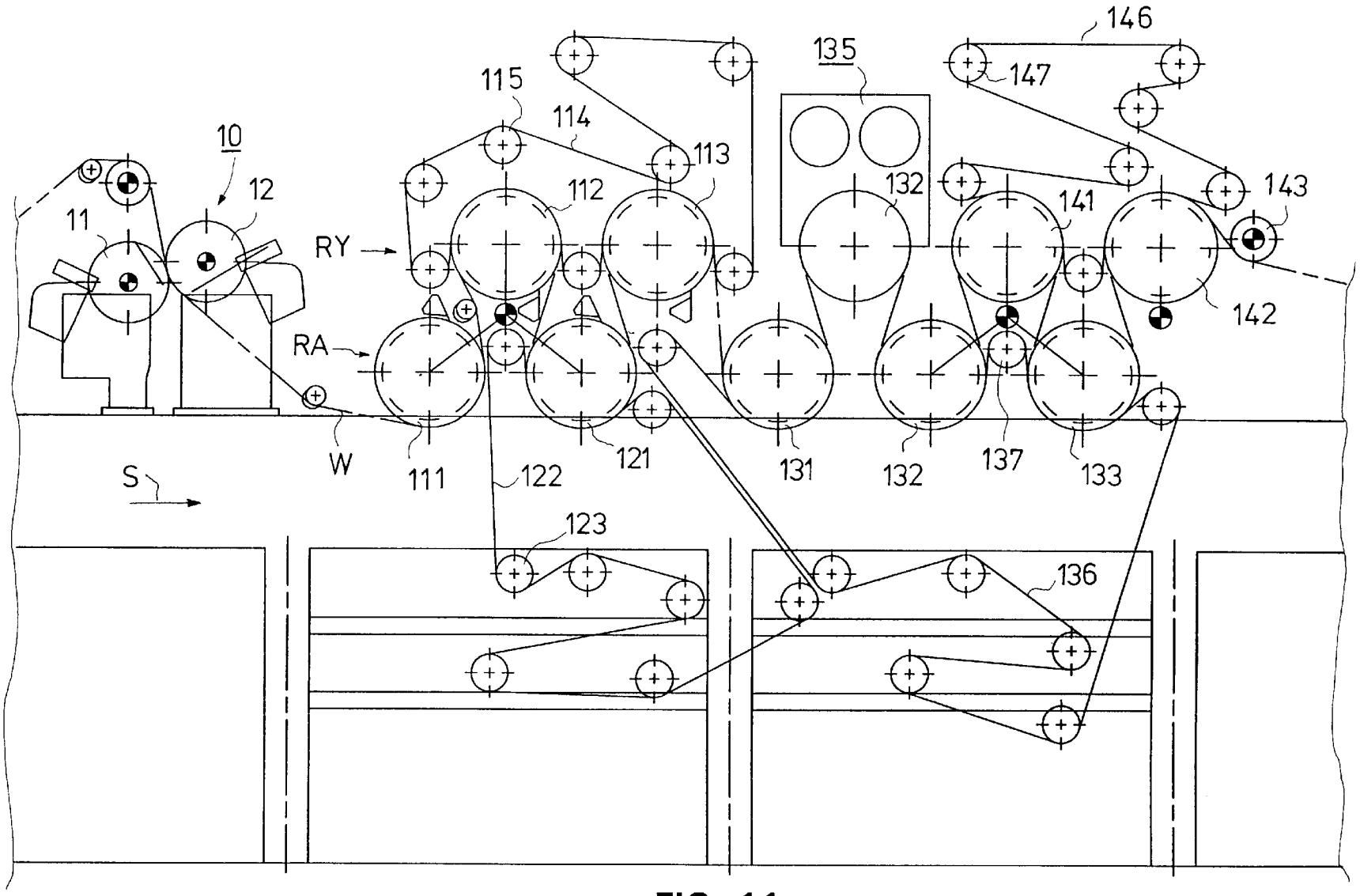
FIG. 11 is a schematic illustration of an exemplifying embodiment of the invention in which the first group in the after-dryer is a group with twin-wire draw, which group is followed by an inverted dryer group with single-wire draw, followed by a dryer group that applies twin-wire draw.

In the exemplifying embodiment shown in FIG. 11, the paper web W, which was coated in the coating device 10, runs first over a drying cylinder 111 into a dryer group with twin-wire draw, in which an upper wire 114 runs guided by guide rolls 15 over drying cylinders 112 and 113 and a lower wire 122 runs over guide rolls 123 and a drying cylinder 121. The web W runs meandering from one row RA to the other row RY, and between the rows RA,RY the web W has free unsupported draws. From the group with twin-wire draw, the web W is passed into the next dryer group, onto a drying cylinder 131 in the lower row, where the web runs on support of a drying wire 136. After this, the web is passed onto a reversing roll/cylinder 132 in the upper row, in connection with which an impingement drying equipment 135 is arranged. Thereafter, the web is passed back to the lower row and further onto drying cylinders 141,142 in the upper row, and in the final part of the group, an ordinary group with twin-wire draw is arranged, in which the wire that operates as the lower wire 136 is common with the wire running through the impingement dryer group, and the drying cylinders 141,142 in the upper row are provided with a drying-wire cycle 146 of their own with guide rolls 147. The web W is passed over the guide roll 143 to possible further processing.

Figure 12A:
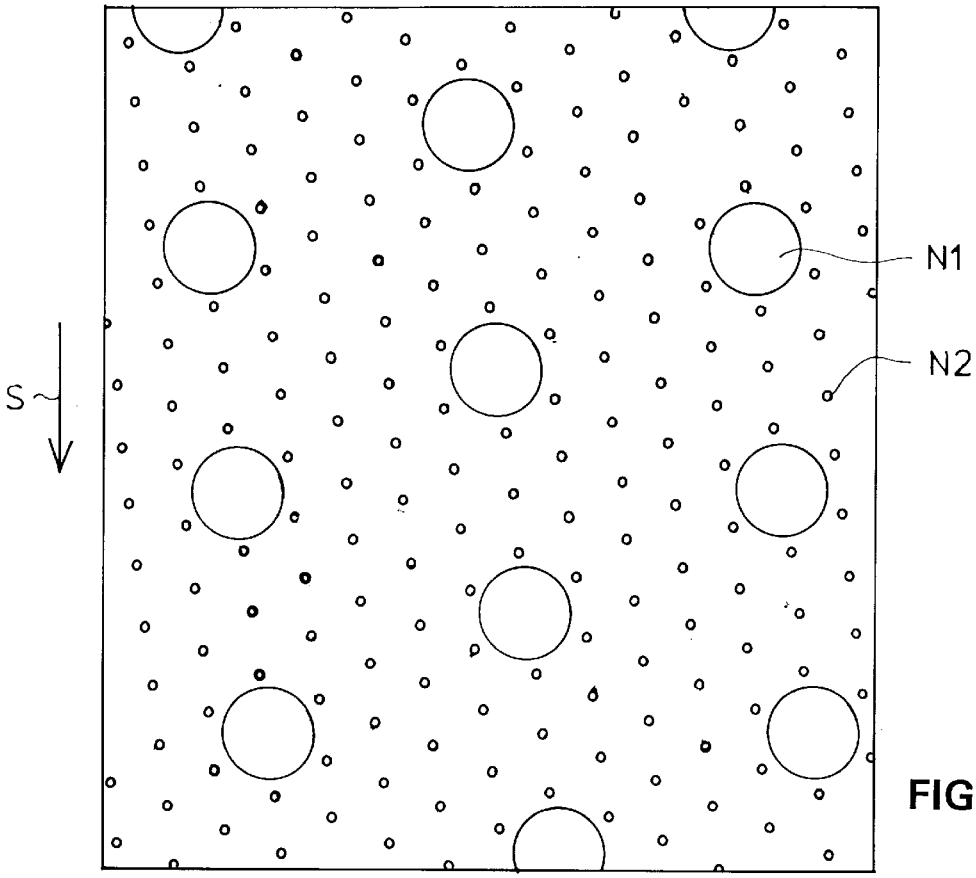
FIGS. 12A and 12B are schematic illustrations of an exemplifying embodiment of the nozzle face of an impingement drying device in accordance with the invention.
Figure 12B:
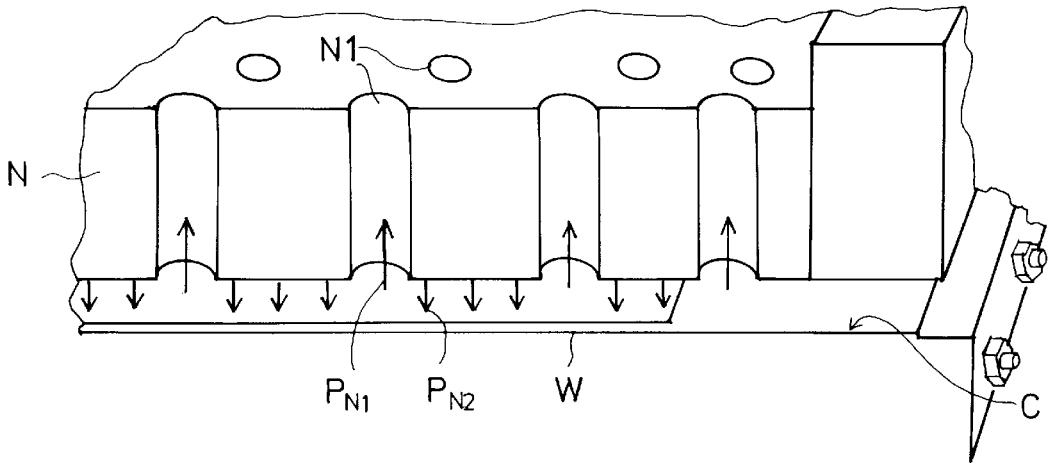

FIGS. 12A and 12B are schematic illustrations of the construction of the nozzle face of the impingement drying device utilized in any of the embodiments in accordance with the invention described herein. In the impingement blowing device, blow holes are denoted by reference N2 and direct an air flow $P_{N2}$ toward the web and exhaust air pipes are denoted by reference N1 and remove an air flow $P_{N1}$ from the vicinity of the web. The diameter of each exhaust air pipe N1 is about 50 mm to about 100 mm, preferably about 75 mm, and the diameter of each blow hole is about 3 mm to about 8 mm, most commonly about 5 mm. The paper web W runs at a distance of about 10 mm to about 150 mm, preferably about 25 mm, from the face of the nozzle plate, and the nozzle chamber of the hood is denoted by reference letter N. The cylinder face against which the impingement-drying device is arranged is denoted by reference C. The open area of the blow holes in the nozzle plate in the area of the web W is about 1% to about 5% and most commonly about 1.5%. The velocity of air in the blow holes is about 40 meters per second to about 150 meters per second, preferably about 100 m.p.s. The air quantity that is blown is about 0.5 to about 2.5 cu.m per second per sq.m, which is calculated for the effective area of the hood. Most commonly an air quantity of about 1 to 1.5 cu.m per second per sq.m is used. The open area of the exhaust air pipes is about 5% to about 15%, most commonly about 10%. In addition to the nozzle face illustrated in FIG. 12A, it is possible to use a commonly known slot nozzle construction, fluid nozzle construction, foil nozzle construction, or a direct-blow nozzle construction as well as, for example, infra dryers, as well as any of those mentioned above alternatingly in the cross direction of the machine as what are called combination dryers.

The impingement drying equipment to be used in connection with the exemplifying embodiments illustrated above in FIGS. 1–11 can be an arrangement of a number of different types and in itself known to a person skilled in the art, in which arrangement drying air flows are blown toward the web to be dried. The impingement drying equipment can be constructed in blocks in the running direction S of the web or in the direction transverse to the running direction, in which case, each block can be regulated separately, if necessary or desired.

In the exemplifying embodiment shown in FIG. 13, after the coating device 10, the paper web W is passed onto a drying cylinder 151, in whose connection an infra drying equipment 152 is arranged. After this, the paper web to be dried is passed over a reversing blow box 153 onto a drying cylinder 154 and further onto a reversing roll or a drying cylinder or equivalent 155. In connection with the cylinder/roll 154, an impingement drying equipment 156 is arranged which can be opened in the manner indicated by arrows S156 for cleaning. The wire draw takes place as a normal single-wire draw as described above in relation to some of the preceding illustrated embodiments. By means of the coating device 10, the coating is applied to the wire side, i.e., as shown in the figure, to the bottom side of the web face W. The hot exhaust air of the infra dryer 152 is passed along a duct 157 through a blower 158 for use in the impingement dryer 156. This infra-heated air can be used directly as impingement blow air, for example, to replace air that would have to be heated otherwise, or as pre-heated air in the burner in which this blow air for the impingement dryer is heated, or as replacement air for the impingement dryer. The impingement drying equipment 156 can be openable towards the bottom by means of pivot members 171.

The exemplifying embodiment shown in FIG. 14 represents an arrangement in which the coating of the web W by means of the coating device 10 is applied to the top side of the web, and the web W is dried first by means of an infra/gas dryer 161, after which the run of the web W is turned by means of a reversing blow box 162 and the web W is passed to run into a group with inverted single-wire draw. In connection with the reversing rolls/cylinders 163, 165 in the inverted group with single-wire draw, impingement drying devices 167 are provided. The exhaust air from the infra/gas dryer 161 is used as drying air for the impingement drying, and the exhaust gas is passed through the ducts 168 and through the blower 169 into the air system of the impingement drying.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

We claim:

1. A method for finishing and drying a paper web in a paper machine comprising the steps of:

surface-sizing or coating the web by means of a finishing device in a finishing section of the paper machine, passing the web through at least one single-wire draw dryer group after the finishing device, each of said at least one single-wire dryer group including first and second rows of web-supporting members and a single drying wire for carrying the web alternatingly between one of said members in said first row and one of said members in said second row, arranging an impingement-drying device in opposed relationship to at least one of said members in said at least one single-wire draw dryer group, and directing a drying medium from said impingement-drying device toward the web as the web runs over said at least one member.

2. The method of claim 1, wherein said members in said first row in a first one of said at least one single-wire draw dryer group in a running direction of the web constitute reversing cylinders and said members in said second row in said first single-wire draw dryer group constitute drying cylinders, further comprising the steps of:

arranging said second row of drying cylinders below said first row of reversing cylinders such that said first single-wire draw dryer group constitutes an inverted single-wire draw dryer group, said impingement-drying device being arranged in opposed relationship to at least one of said reversing cylinders in said first row of said inverted single-wire draw dryer group, guiding the web from the finishing device initially over a first one of said drying cylinders in said second row of said inverted single-wire draw dryer group, and passing the web from said inverted single-wire draw dryer group into a twin-wire draw dryer group including first and second rows of drying cylinders, a first drying wire for carrying the web over said first row of drying cylinders and a second drying wire for carrying the web over said second row of drying cylinders.

3. The method of claim 1, further comprising the step of:

drying the web between the finishing device and said at least one single-wire draw dryer group by means of an airborne web dryer.

4. The method of claim 3, further comprising the step of:

passing the web over a reversing blow device after the finishing device and before said airborne web dryer to change the running direction of the web.

5. The method of claim 1, wherein said members in said first row in a first one of said at least one single-wire draw dryer group in a running direction of the web constitute reversing cylinders and said members in said second row in said first single-wire draw dryer group constitute drying cylinders, further comprising the steps of:

arranging said second row of drying cylinders below said first row of reversing cylinders such that said first single-wire draw dryer group constitutes an inverted single-wire draw dryer group, said impingement-drying device being arranged in opposed relationship to at least one of said reversing cylinders in said first row of said inverted single-wire draw dryer group, and passing the web over a reversing blow device between the finishing device and said inverted single-wire draw dryer group to change the running direction of the web and direct the web into said inverted single-wire draw dryer group.

6. The method of claim 1, wherein said members in said first row in a first one of said at least one single-wire draw dryer group in a running direction of the web constitute reversing cylinders and said members in said second row in said first single-wire draw dryer group constitute reversing blow devices, further comprising the steps of:

arranging said second row of reversing blow devices below said first row of reversing cylinders, said impingement-drying device being arranged in opposed relationship to at least one of said reversing cylinders in said first row of said inverted single-wire draw dryer group, and passing the web over a first one of said reversing blow devices between the finishing device and said inverted single-wire draw dryer group.

7. The method of claim 1, wherein said members in said first row in a first one of said at least one single-wire draw dryer group in a running direction of the web constitute reversing cylinders and said members in said second row in said first single-wire draw dryer group constitute drying cylinders, further comprising the steps of:

arranging said second row of drying cylinders above said first row of reversing cylinders such that said first single-wire draw dryer group constitutes a normal single-wire draw dryer group, said impingement-drying device being arranged in opposed relationship to at least one of said reversing cylinders in said first row of said normal single-wire draw dryer group, passing the web over a reversing blow device between the finishing device and said normal single-wire draw dryer group, guiding the web from the finishing device over a first one of said drying cylinders in said second row of said normal single-wire draw dryer group, and passing the web from said normal single-wire draw dryer group into a twin-wire draw dryer group including first and second rows of drying cylinders, a first drying wire for carrying the web over said first row of drying cylinders and a second drying wire for carrying the web over said second row of drying cylinder.

8. The method of claim 1, wherein said at least one single-wire draw dryer group comprises first and second successively arranged single-wire draw dryer groups and said members in said first row in said first and second single-wire draw dryer groups constitute reversing cylinders and said members in said second row in said first and second single-wire draw dryer groups constitute drying cylinders, further comprising the steps of:

arranging said second row of drying cylinders above said first row of reversing cylinders in said first and second single-wire draw dryer groups such that said first and second single-wire draw dryer groups constitute normal single-wire draw dryer groups, said impingement-drying device being arranged in opposed relationship to at least one of said reversing cylinders in said first row of said second single-wire draw dryer group, passing the web over a pair of drying cylinders between the finishing device and said first single-wire draw dryer group, guiding the web from the finishing device over a first one of said drying cylinders in said second row of said first single-wire draw dryer group into said first single-wire draw dryer group, and transferring the web from said first single-wire draw dryer group to said second single-wire draw dryer group over a drying cylinder.

9. The method of claim 1, wherein said at least one single-wire draw dryer group comprises first, second and third successively arranged single-wire draw dryer groups, said members in said first row in said first, second and third single-wire draw dryer groups constituting reversing cylinders and said members in said second row in said first, second and third single-wire draw dryer groups constituting drying cylinders, further comprising the steps of:

arranging said first row of reversing cylinders below said second row of drying cylinders in said first, second and third single-wire draw dryer group such that said first, second and third single-wire draw dryer groups constitute normal single-wire draw dryer groups, said second row of drying cylinders in said second normal single-wire draw dryer group including a large-diameter drying cylinder having a diameter larger than said drying cylinders in said second row in said first and third normal single-wire draw dryer groups, said impingement-drying device being arranged in opposed relationship to said large-diameter cylinder, and passing the web over a pair of drying cylinders between the finishing device and said first single-wire draw dryer group.

10. The method of claim 9, further comprising the step of:

drying the web between the finishing device and said first normal single-wire draw dryer group by means of an airborne web dryer.

11. The method of claim 1, wherein said first row of a first one of said at least one single-wire draw dryer group in a running direction of the web comprises a single large-diameter reversing cylinder and said members in said second row of said first single-wire draw dryer group comprise drying cylinders, further comprising the steps of:

passing the web from the finishing device over a first one of said drying cylinders in said second row of said first single-wire draw dryer group onto said large-diameter reversing cylinder, said impingement-drying device being arranged in opposed relationship to said large-diameter reversing cylinder, passing the web from said large-diameter reversing cylinder to a second one of said drying cylinders in said second row of said first single-wire draw dryer group, and passing the web from said second drying cylinder over a reversing cylinder into a dryer group with twin-wire draw including first and second rows of drying cylinders, a first drying wire for carrying the web over said first row of drying cylinders and a second drying wire for carrying the web over said second row of drying cylinders.

12. The method of claim 1, further comprising the steps of:

passing the web from the finishing device over a drying cylinder into a dryer group with twin-wire draw including first and second rows of drying cylinders, a first drying wire for carrying the web over said first row of drying cylinders and a second drying wire for carrying the web over said second row of drying cylinders, and passing the web from said twin-wire draw dryer group into said at least one single-wire draw dryer group, and passing the web from said at least one single-wire draw dryer group into an additional dryer group with twin-wire draw including first and second rows of drying cylinders, a first drying wire for carrying the web over said first row of drying cylinders and a second drying wire for carrying the web over said second row of drying cylinders.

13. The method of claim 1, further comprising the steps of:

pre-drying the web after the finishing device and before said at least one single-wire draw dryer group by means of an infra dryer, said infra dryer generating exhaust air, and directing the exhaust air from said infra dryer to said impingement-drying device.

14. The method of claim 1, wherein said at least one single-wire draw dryer group comprises a plurality of single-wire draw dryer groups, further comprising the step of:

passing the web in a closed draw between adjacent ones of said single-wire draw dryer groups.

15. A paper machine, comprising a finishing section including a finishing device for surface-sizing or coating a paper web, and an after-dryer arranged after the finishing device for drying the surface-sized or coated web, said after-dryer comprising at least one single-wire draw dryer group arranged after the finishing device, each of said at least single-wire draw dryer group including first and second rows of web-supporting members and a single drying wire for carrying the web over said members, and an impingement-drying device arranged in opposed relationship to at least one of said members in said at least one single-wire draw dryer group for directing a drying medium toward the web as the web runs over said at least one member.

16. The paper machine of claim 15, wherein said members in said first row in a first one of said at least one single-wire draw dryer group in a running direction of the web constitute reversing cylinders and said members in said second row in said first single-wire draw dryer group constitute drying cylinders, said first row of reversing cylinders being arranged above said second row of drying cylinders such that said first single-wire draw dryer group constitutes an inverted single-wire draw dryer group, said impingement-drying device being arranged in opposed relationship to at least one of said reversing cylinders, said after-dryer further comprising a twin-wire draw dryer group arranged after said inverted single-wire draw dryer group in the running direction of the web, said twin-wire draw dryer group including first and second rows of drying cylinders, a first drying wire for carrying the web over said first row of drying cylinders and a second drying wire for carrying the web over said second row of drying cylinders.

17. The paper machine of claim 16, wherein said after-dryer further comprises an airborne web dryer arranged between the finishing device and said at least one single-wire draw dryer group for drying the web.

18. The paper machine of claim 16, wherein said after-dryer further comprises a reversing blow device arranged between the finishing device and a first one of said at least one single-wire draw dryer group in the running direction of the web for changing the running direction of the web.

19. The paper machine of claim 16, wherein said members in said first row in a first one of said at least one single-wire draw dryer group in a running direction of the web constitute reversing cylinders and one of said members in said second row in said first single-wire draw dryer group constitutes a reversing blow device, said first row of reversing cylinders being arranged above said second row of members, said impingement-drying device being arranged in opposed relationship to at least one of said reversing cylinders.

20. The paper machine of claim 16, wherein said members in said first row in a first one of said at least one single-wire draw dryer group in a running direction of the web constitute reversing cylinders and said members in said second row in said first single-wire draw dryer group constitute drying cylinders, said first row of reversing cylinders being arranged below said second row of drying cylinders such that said first single-wire draw dryer group constitutes a normal single-wire draw dryer group, said impingement-drying device being arranged in opposed relationship to at least one of said reversing cylinders, said after-dryer further comprising a twin-wire draw dryer group arranged after said normal single-wire draw dryer group in the running direction of the web, said twin-wire draw dryer group including first and second rows of drying cylinders, a first drying wire for carrying the web over said first row of drying cylinders and a second drying wire for carrying the web over said second row of drying cylinders.

21. The paper machine of claim 16, wherein said at least one single-wire draw dryer group consists of two successively arranged single-wire draw dryer groups, said impingement drying device being arranged in opposed relationship to at least two of said member in said second row in one of said two single-wire draw dryer groups.

22. The paper machine of claim 21, wherein said after-dryer further comprises an airborne web dryer arranged between the finishing device and said at least one single-wire draw dryer group for drying the web.

23. The paper machine of claim 16, wherein said members in said first row in a first one of said at least one single-wire draw dryer group in a running direction of the web constitute drying cylinders and one of said members in said second row in said first single-wire draw dryer group is a large-diameter cylinder, said impingement-drying device being arranged in opposed relationship to said large-diameter cylinder.

24. The paper machine of claim 16, wherein said after-dryer further comprises a twin-wire draw dryer group arranged before a first one of said at least one single-wire draw dryer group in the running direction of the web, the web being passed from the finishing device into said twin-wire draw dryer group, said twin-wire draw dryer group including first and second rows of drying cylinders, a first drying wire for carrying the web over said first row of drying cylinders and a second drying wire for carrying the web over said second row of drying cylinders, said members in said first row in said first single-wire draw dryer group constituting reversing cylinders and said members in said second row in said first single-wire draw dryer group constituting drying cylinders, said first row of reversing cylinders being arranged above said second row of drying cylinders such that said first single-wire draw dryer group constitutes an inverted single-wire draw dryer group, said impingement-drying device being arranged in opposed relationship to at least one of said reversing cylinders.

25. The paper machine of claim 16, wherein said after-dryer further comprises an infra dryer arranged in opposed relationship to one of said member in said at least one single-wire draw dryer group, said infra dryer generating exhaust air, a duct for fluidly coupling said infra dryer and said impingement-drying device, and a blower for passing the exhaust air from said infra dryer to said impingement-drying device.

26. The paper machine of claim 16, wherein said at least one single-wire draw dryer group comprises a plurality of single-wire draw dryer groups, the web being passed between adjacent ones of said single-wire draw dryer groups in a closed draw.

* * * * *